US007631458B2

(12) United States Patent
Moriyama et al.

(10) Patent No.: US 7,631,458 B2
(45) Date of Patent: Dec. 15, 2009

(54) WIRE DRUM WINDOW REGULATOR

(75) Inventors: Tomohiro Moriyama, Nagano (JP); Hakurei Watanabe, Wako (JP); Takashi Ogawa, Wako (JP)

(73) Assignees: Johnan Manufacturing Co., Ltd., Ueda (JP); Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 11/447,284

(22) Filed: Jun. 6, 2006

(65) Prior Publication Data

US 2007/0044382 A1 Mar. 1, 2007

(30) Foreign Application Priority Data

Aug. 23, 2005 (JP) ..... 2005-241361

(51) Int. Cl.
*E05F 11/48* (2006.01)

(52) U.S. Cl. ..... 49/352; 49/349

(58) Field of Classification Search ..... 49/352, 49/348, 349

See application file for complete search history.

(56) References Cited

U.S. PATENT DOCUMENTS

| | | | | |
|---|---|---|---|---|
| 4,691,475 | A * | 9/1987 | Maekawa | 49/352 |
| 5,740,630 | A * | 4/1998 | Medebach | 49/352 |
| 6,256,929 | B1 * | 7/2001 | Serrano et al. | 49/352 |
| 6,536,164 | B1 * | 3/2003 | Kirejczyk | 49/502 |
| 6,640,497 | B2 * | 11/2003 | Sakaguchi et al. | 49/352 |
| 6,688,043 | B1 * | 2/2004 | Feder et al. | 49/352 |
| 6,820,370 | B2 * | 11/2004 | Marscholl | 49/352 |
| 2001/0025456 | A1 * | 10/2001 | Furuyama et al. | 49/502 |
| 2001/0034975 | A1 * | 11/2001 | Dobson et al. | 49/352 |
| 2002/0050099 | A1 * | 5/2002 | Marscholl | 49/352 |
| 2004/0107644 | A1 * | 6/2004 | Ishii et al. | 49/352 |
| 2005/0188621 | A1 * | 9/2005 | Kinoshita et al. | 49/352 |

FOREIGN PATENT DOCUMENTS

| | | |
|---|---|---|
| JP | 3-209042 | 9/1991 |
| JP | 6-32133 | 4/1994 |
| JP | 2002-4708 | 1/2002 |
| JP | 2002-103974 | 4/2002 |
| JP | 2002-266553 | 9/2002 |
| JP | 2002-364242 | 12/2002 |

OTHER PUBLICATIONS

Japanese Office Action issued on Nov. 6, 2008 in corresponding Japanese Patent Application 2005-241361.
Japanese Final Office Action issued on Feb. 3, 2009 in corresponding Japanese Patent Application 2005-241361.
Chinese Office Action mailed May 22, 2009 and issued in corresponding Patent Application No. 2006101159716.

* cited by examiner

*Primary Examiner*—Gregory J. Strimbu

(57) ABSTRACT

A guide rail assembly includes a guide rail, a slider that slides along the guide rail, a wire fixed to the slider, and upper and lower wire feeders located at the upper and lower ends of the guide rail. The guide rail assembly, a drum around which the wire is wound, and a motor for turning the drum are mounted on a base bracket to form a single unit which is attached to a door inner panel.

1 Claim, 4 Drawing Sheets

WIRE DRUM WINDOW REGULATOR

BACKGROUND OF THE INVENTION

1. Field of the Invention

This invention relates to a wire drum window regulator mounted on a door inner panel of a vehicle to raise and lower a glass window of the vehicle.

2. Description of the Related Art

Window regulators are mounted on the door inner panels of vehicles to raise and lower their glass windows. A conventional wire drum window regulator generally comprises a guide rail extending in the vertical direction (or in the direction of movement of the glass window), upper and lower pulleys rotatably attached to the guide rail at the upper and lower ends thereof, a driving motor, a drum which is turned forward and backward by the driving motor, a wire which is wound around the drum, the upper pulley, and the lower pulley, and a slider which is affixed to the wire and attached to the bottom of the glass window and slides along the guide rail (see Japanese Patent Application Laid-Open No. 2002-266553).

In the above wire drum window regulator, the guide rail with its upper pulley, lower pulley and slider (or the guide rail assembly) is first secured to the door inner panel by four-point attachment. Next, a drum base assembly (driving assembly) in which the driving motor and the drum are integrally mounted is directly secured to the door inner panel by three-point attachment. The wire wound around the drum is then engaged with the pulleys and the glass window is attached to the slider.

The installation of a conventional wire drum window regulator as described above is inefficient because the work requires many steps. In addition, the drum base assembly is installed laterally adjacent to the guide rail assembly with a clearance left between the drum and the guide rail, but the attachment of the guide rail assembly to the door inner panel is performed separately from the attachment of the drum base assembly to the door inner panel. The positional relationship between the guide rail assembly and the drum base assembly is accordingly undetermined, making the mounting work difficult.

Because the positional relationship of the guide rail assembly and the drum base assembly is undetermined as described above, a slight slack is allowed in the wire to facilitate the mounting work. However, the wire needs to be tensioned upon completion of the mounting work. Therefore, an outer tube through which the wire is passed and a spring by which the outer tube is bent to place the wire under tension become necessary. Another problem is that, since the drum base assembly is attached to the door inner panel, the vibration of the driving motor is transferred directly to the door inner panel, becoming a source of noise.

SUMMARY OF THE INVENTION

An object of the present invention is to provide a wire drum window regulator that can resolve the above problems of the prior art and reduce the number of installation steps.

To achieve this object, the wire drum window regulator according to the present invention comprises a base bracket structured to be attachable to a door inner panel; a guide rail assembly which includes a guide rail disposed in such a manner that the longitudinal direction of the guide rail coincide with a direction of movement of a glass window, a slider sliding on the guide rail in the longitudinal direction thereof, upper and lower wire feed means provided on the guide rail at the upper and lower ends thereof, and a wire guided by the upper and lower wire feed means and having both ends connected to the slider; a drum around which a middle part of the wire is wound; and a motor for rotationally driving the drum. The guide rail assembly, the drum and the motor are integrally disposed on the base bracket, forming a single unit.

Since the components of the above wire drum window regulator have previously been integrally mounted on the base bracket as a single unit, it is only required that the base bracket, which has been assembled in advance as a unit, be attached to a door inner panel, as a result, the number of steps in the installation job is reduced. Further, the motor is fixed to the base bracket, so the vibration of the motor is not directly transferred to the door inner panel, resolving the noise problem. In addition, when mounted, the base bracket improves the rigidity of the door inner panel around the installation opening.

A wire drum window regulator according to one possible aspect of the present invention is as follows.

The base bracket is rectangular and has mounting sections for attachment to the door inner panel at four corners thereof. The guide rail assembly is disposed near a left or right side of the base bracket. The drum is disposed on the base bracket, laterally adjacent to a longitudinal midpoint of the guide rail, with a clearance left between the drum and the guide rail.

In the wire drum window regulator according to the above aspect, the only necessary attachments are attachments at the mounting sections in the four corners, which simplifies installation in the door inner panel. Since the guide rail assembly is disposed near the left or right side of the base bracket and the drum is disposed on the base bracket, laterally adjacent to the longitudinal midpoint of the guide rail with a clearance left between the drum and the guide rail, the positional relationship between the guide rail assembly and the drum has been set in advance, and also the positional relationship between the drum and the upper and lower wire feeding means provided on the guide rail at the upper and lower ends thereof has been set in advance, during the installation work. For this reason, as the wire can be wound around the wire feeding means and the drum in advance under tension, it is not necessary to use an outer tube for insertion of the wire, thereby allowing the cost of such an outer tube to be eliminated. Further, the wire can be fed without being deflected.

BRIEF DESCRIPTION OF THE DRAWINGS

These and other objects and features of the present invention will be apparent from the description of the following embodiments with reference to the accompanying drawings, in which.

DETAILED DESCRIPTION OF THE PREFERRED EMBODIMENTS

Figure 1:
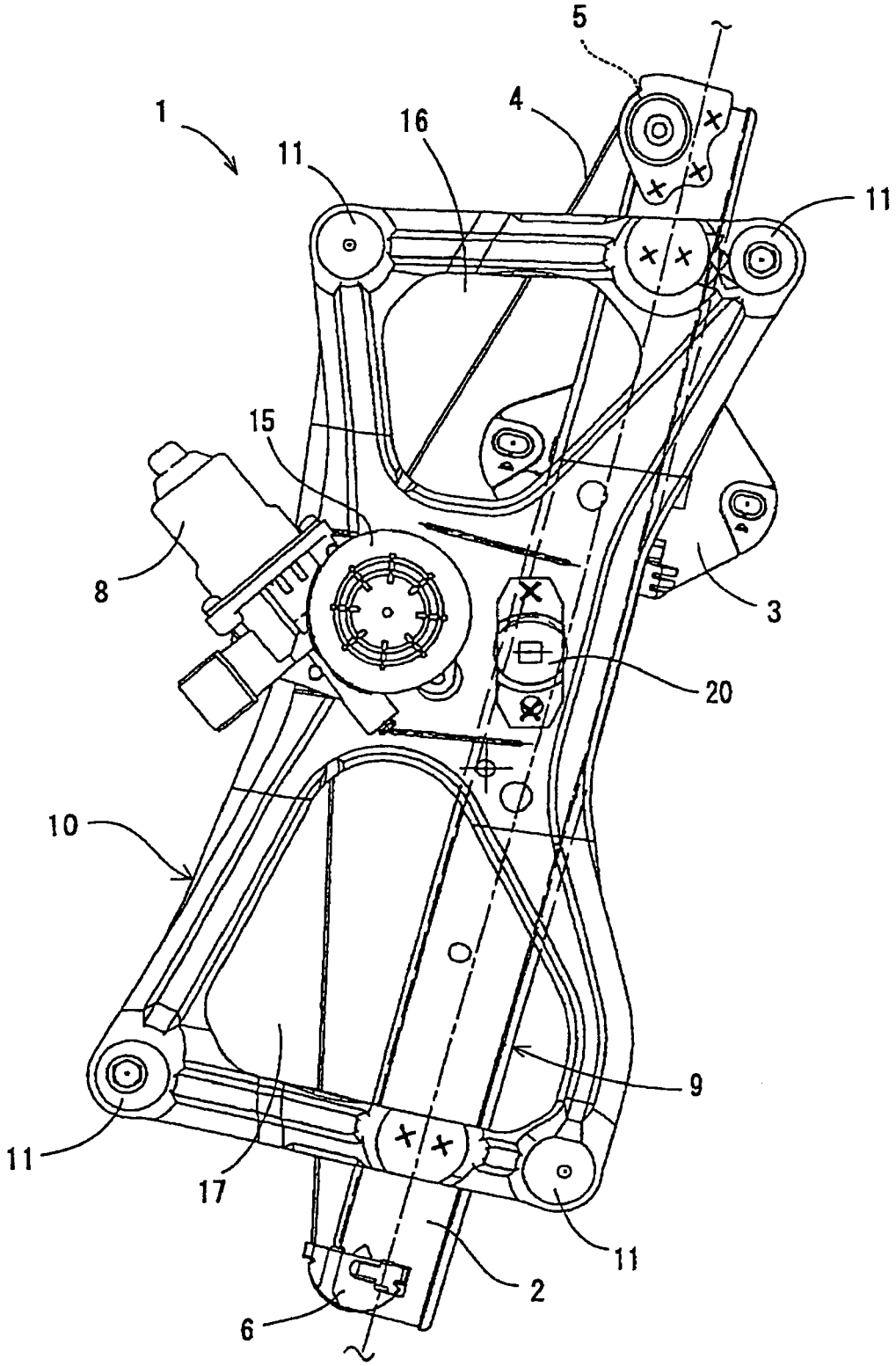
FIG. 1 is a front view of a wire drum window regulator according to one embodiment of the present invention, as viewed from the interior of a vehicle.
Figure 2:
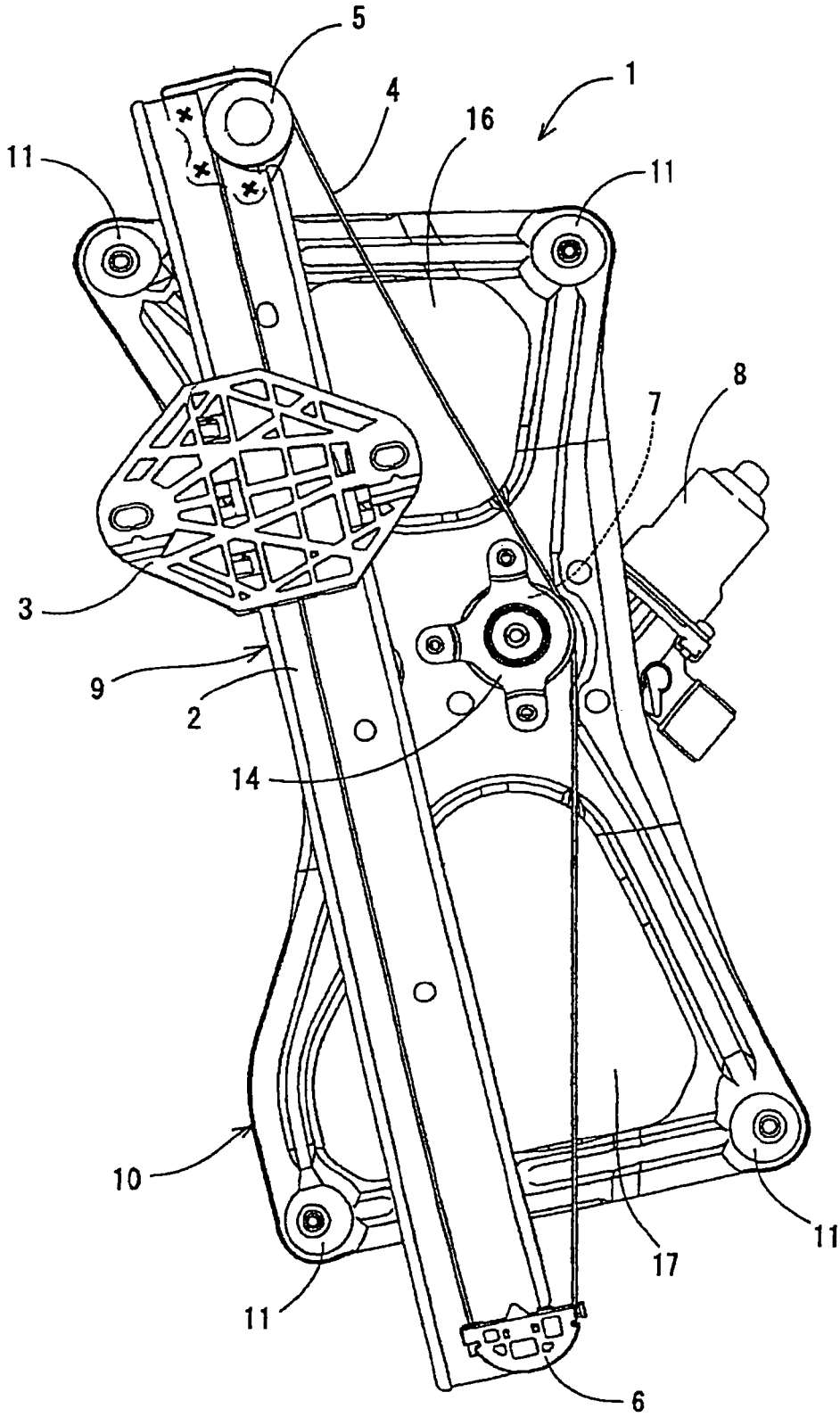
FIG. 2 is a rear view of the wire drum window regulator in FIG. 1 as viewed from the exterior of the vehicle.

As shown in FIGS. 1 and 2, the wire drum window regulator 1 has a guide rail 2 oriented in the direction of movement (up and down) of the glass window (not shown), a slider 3 that slides along the guide rail 2, a wire 4 with both ends connected to the slider 3, a pulley 5 (upper wire feed means) rotatably attached to the guide rail 2 at the upper end thereof, a shoe 6 (lower wire feed means) provided to the guide rail 2 at the lower end thereof, a drum 7 with a rim around which the wire 4 is wound, a motor 8 for turning the drum 7 forward and backward, and a base bracket 10. The slider 3 is connected to the glass window. The base bracket 10 is fixed to a door inner panel (not shown).

The pulley 5 and shoe 6 are means for feeding the wire 4. The shoe 6, which is the lower wire feed means, can be replaced with a pulley. The guide rail 2, slider 3, wire 4, pulley 5 and shoe 6 constitute a guide rail assembly 9. The slider 3 is connected to a bracket (not shown) fastened to the lower end of the glass window and ascends or descends between the pulley 5 and the shoe 6 along the guide rail 2.

The wire drum window regulator 1 according to present invention is characterized in that the guide rail assembly 9, the drum 7, and the motor 8, which constitute the wire drum window regulator 1, are integrated into a unitary structure (a single unit).

Figure 4:
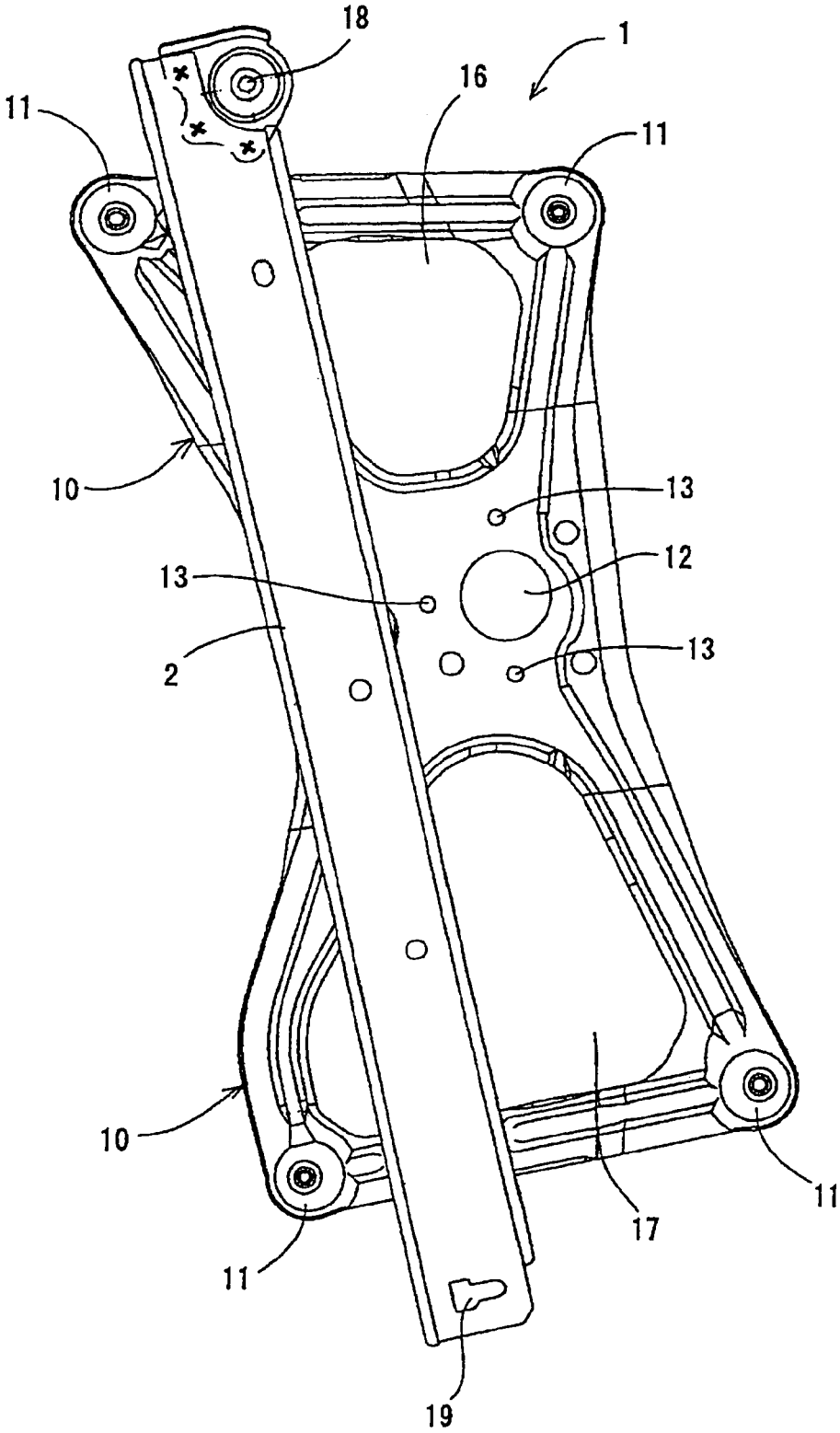
FIG. 4 is a rear view of the wire drum window regulator in FIG. 2 with the slider, wire, pulley, shoe, drum and motor removed.

FIG. 4 is a view showing the wire drum window regulator in FIG. 2 with the slider 3, wire 4, pulley 5, shoe 6, drum 7 and motor 8 removed to illustrate the structure of the base bracket 10 and the guide rail 2 fixed to the base bracket 10.

Figure 3:
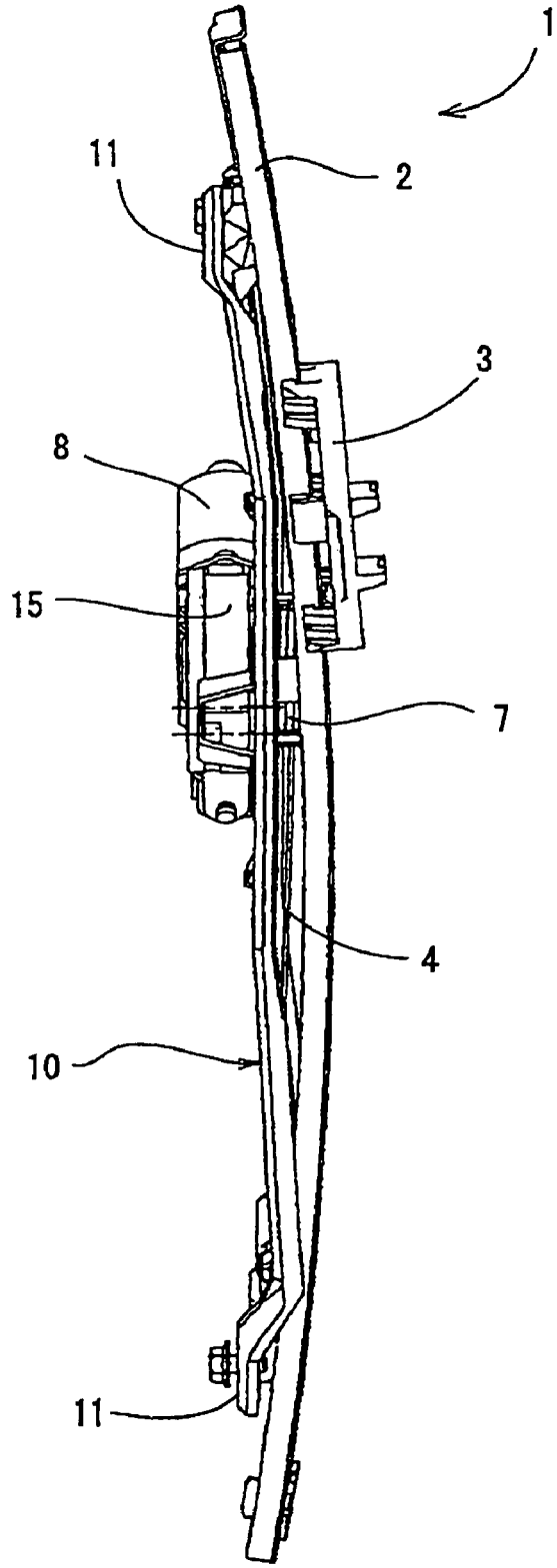
FIG. 3 is a left side view of the wire drum window regulator in FIG. 1.

The base bracket 10 comprises a substantially rectangular panel member having a prescribed thickness (see FIG. 3), a front surface (see FIG. 1) and a rear surface (see FIG. 2). The rectangular base bracket 10 has mounting sections 11 disposed at its four corners, where the base bracket 10 is attached to the door inner panel (not shown).

The guide rail 2 is affixed to the rear surface of the base bracket 10 (the surface facing the door inner panel) near the left or right side of the base bracket, as shown in FIG. 2, the longitudinal direction of the guide rail 2 being oriented in the vertical direction, substantially parallel to one side of the rectangle of the base bracket 10. To attach the guide rail 2 to the rear surface of the base bracket 10, the upper end of the guide rail may, for example, be spot-welded to the upper end of the base bracket 10 and the lower end of the guide rail may be spot-welded to the lower end of the base bracket 10.

As shown in FIG. 4, a drum installation section 12 having a circular through hole is formed slightly to the right of the center of the rectangular base bracket 10, that is, laterally adjacent to the longitudinal midpoint of the guide rail 2 with a clearance left between the drum and the guide rail. Drum mounting holes 13 are formed in three positions around the through hole of the drum installation section 12.

The drum 7 has a drum bracket 14 as shown in FIG. 2. The drum bracket 14 is installed in the drum mounting holes 13 of the base bracket 10 by burring and caulking or other means in order to attach the drum 7 to the drum installation section 12 of the base bracket 10 (see FIG. 2). The drum 7 is thereby installed on the rear surface of the base bracket 10, laterally adjacent to the guide rail 2 affixed to the rear surface of the base bracket 10, with a clearance left between the drum and the guide rail.

As shown in FIG. 1, the motor 8 for turning the drum 7 forward and backward and a speed reducing mechanism 15 including a gear train connected to the driving shaft of the motor 8 are affixed to the front surface of the base bracket 10 at the longitudinal midpoint thereof. The output shaft (not shown) of the speed reducing mechanism 15 is concentrically aligned with the rotating shaft of the drum 7 installed in the drum installation section 12 (see FIG. 3). Therefore, when the motor 8 is driven, the rotation of the driving shaft of the motor 8 is transferred to the rotating shaft of the drum 7 through the output shaft of the speed reducing mechanism 15, with the result that the drum 7 turns forward or backward.

In this embodiment, in order to integrate the guide rail assembly 9, drum 7 and motor 8 into a one-piece unit structure on the base bracket 10, the motor 8 and the drum 7 are arranged on the base bracket 10 substantially at the longitudinal midpoint thereof, with the result that the center of gravity of the unit is located substantially at the center of the unit, which facilitates the work of mounting the unit.

Openings 16 and 17 are formed in the rectangular base bracket 10 in the upper and lower central areas thereof, excluding the circumferential portions, in a manner such that it penetrates the base bracket 10.

The shaft of the pulley 5 is installed in a support hole 18 formed at the upper end of the guide rail 2 as shown in FIG. 4. The shoe 6 is installed in a shoe engagement hole 19 formed at the lower end of the guide rail 2. In addition, as shown in FIG. 2, the slider 3 is installed on the guide rail 2 between the pulley 5 and the shoe 6 so that it can slide in the longitudinal direction of the guide rail 2.

One end of the wire 4, several turns of which are wound around the rim of the drum 7 installed in the drum installation section 12, extends upward in a slanting direction to the upper end of the guide rail 2, is guided and turned by the pulley 5 installed at the upper end of the guide rail 2, extends downward along the guide rail 2, and is then fixed to the slider 3, as shown in FIG. 2. The other end of the wire 4 extends downward in a slanting direction to the lower end of the guide rail 2, is guided and turned by the shoe 6, extends upward along the guide rail 2, and is then fixed to the slider 3.

A pull pocket bracket 20, shown in FIG. 1, is installed by spot welding or other means laterally adjacent to the speed reducing mechanism 15 on the front surface of the base bracket 10 to support a storage pull pocket disposed inside the vehicle door.

The wire drum window regulator 1 structured as described above is installed in an installation opening in the door inner panel (not shown). The wire drum window regulator 1 is fixed to the door inner panel by bolts that pass through the mounting sections 11 provided to the base bracket 10 at the four corners thereof.

In the present invention, as described above, the components of the window regulator 1 are assembled into a single unit (one-piece structure) on the base bracket 10 in advance (or before the wire drum window regulator 1 is fixed to the door inner panel). Accordingly, the installation of the wire drum window regulator 1 in the door inner panel only requires the mounting of the base bracket 10, assembled in advance into a single unit, on the door inner panel, thereby reducing the number of steps in the installation job. In addition, the only installation work to be done is insertion of bolts into the mounting sections provided to the base bracket 10 at the four corners thereof and then screwing of the bolts into the door inner panel, so the work of mounting the wire drum window regulator 1 on the door inner panel is easy to do. Mounting of the base bracket 10 on the door inner panel also improves the rigidity of the door inner panel at the installation opening.

Since the motor 8 is fixed to the base bracket 10, the vibration of the motor 8 is not directly transferred to the door inner panel, whereby the noise problem is resolved.

In the present invention, as described above, the guide rail assembly 9 is disposed near the left or right side of the base bracket 10 and the drum 7 is disposed laterally adjacent to the longitudinal midpoint of the guide rail 2 with a clearance left between the drum and the guide rail. Accordingly, when the wire drum window regulator 1 is to be mounted, the positional relationship between the guide rail assembly 9 and the drum 7 has been set in advance, and also the positional relationship between the drum 7 and the pulley 5 and the shoe 6 provided on the guide rail 2 at the upper and lower ends thereof has been set in advance. For this reason, as the wire 4 can be wound around the pulley 5, shoe 6 and drum 7 in advance under tension, it is not necessary to use an outer tube for insertion of the wire 4, thereby allowing the cost of such an outer tube to be eliminated. Further, the wire 4 can be driven without being deflected.

Forming of the large openings 16 and 17 in the rectangular base bracket 10 in the upper and lower central areas thereof excluding the circumferential portions will reduce the weight of the window regulator. Workability is improved because a worker can hold the entire wire drum window regulator 1 with one hand by using the openings 16 and 17 when mounting the wire drum window regulator 1 (base bracket 10).

The wire drum window regulator 1 operates in the conventional manner. When the motor 8 is driven to turn the drum 7 clockwise in FIG. 2, the part of the wire 4 above the drum 7 is wound onto the drum 7 and the part of the wire 4 below the drum 7 is unwound from the drum 7. As a result, the wire 4 slides upward along the guide rail 2. The slider 3 fixed to the wire 4 ascends along the guide rail 2 and lifts the glass window upward.

When the motor 8 is reversed to turn the drum 7 counterclockwise, the part of the wire 4 above the drum 7 is unwound from the drum 7 and the part of the wire 4 below the drum 7 is wound onto the drum 7. As a result, the wire 4 slides downward along the guide rail 2, and the slider 3 fixed to the wire 4 and the glass window fixed to the slider 3 descend.

Since the pull pocket bracket 20 is provided on the front surface of the base bracket 10, vibrations are not directly transferred to the guide rail 2 when the pull pocket is operated, as compared with the case where a pull pocket bracket is directly provided on the reverse side of a guide rail, so the upward or downward motion of the glass window is not affected, thereby making the upward or downward motion more stable, improving strength when the pull pocket is used.

The invention claimed is:

1. A wire drum window regulator, comprising:

a substantially rectangular base bracket having top and bottom sides and left and right sides substantially perpendicular to said top and bottom sides, each of said left and right sides being longer than each of said top and bottom sides, said base bracket having four corners and a mounting section at each of said four corners;

a guide rail assembly which includes:

a guide rail disposed longitudinally between said left and right sides of the substantially rectangular base bracket, the guide rail having an upper protrusion projected upward beyond said top side of said substantially rectangular base bracket, said upper protrusion being cantilevered relative to the substantially rectangular base bracket, and a lower protrusion projected downward beyond said bottom side of said substantially rectangular base bracket, said lower protrusion being cantilevered relative to the substantially rectangular base bracket, a slider slidable on said guide rail in the longitudinal direction thereof, upper and lower wire feeders each mounted on a respective one of said upper and lower protrusions of said guide rail, and a wire guided by said upper and lower wire feeders and having both ends connected to said slider;

a drum around which a middle part of said wire is wound, the drum being disposed adjacent one of the left and right sides of the substantially rectangular base bracket and said guide rail disposed adjacent the other one of the left and right sides of the substantially rectangular base bracket such that said drum is disposed closer to said one of the left and right sides of the substantially rectangular base bracket than said guide rail and said guide rail is disposed closer to said other one of the left and right sides of the substantially rectangular base bracket than said drum; and a motor rotationally driving said drum;

wherein said guide rail assembly, said drum and said motor are integrally disposed on said base bracket, forming a single unit which is attached only via the substantially rectangular base bracket to a door inner panel.

* * * * *

UNITED STATES PATENT AND TRADEMARK OFFICE

CERTIFICATE OF CORRECTION

PATENT NO. : 7,631,458 B2
APPLICATION NO. : 11/447284
DATED : December 15, 2009
INVENTOR(S) : Tomohiro Moriyama et al.

It is certified that error appears in the above-identified patent and that said Letters Patent is hereby corrected as shown below:

Title page, Column 1 (Title), Line 1, change "WIRE DRUM WINDOW REGULATOR" to --WIRE DRUM WINDOW REGULATOR HAVING A GUIDE RAIL ASSEMBLY, A DRUM AND A MOTOR INTEGRALLY DISPOSED ON A BASE BRACKET--.

Column 1, Line 1 (Title), change "WIRE DRUM WINDOW REGULATOR" to --WIRE DRUM WINDOW REGULATOR HAVING A GUIDE RAIL ASSEMBLY, A DRUM AND A MOTOR INTEGRALLY DISPOSED ON A BASE BRACKET--.

Signed and Sealed this

Twenty-third Day of March, 2010

David J. Kappos

David J. Kappos
*Director of the United States Patent and Trademark Office*